US012446715B1

(12) United States Patent
Wright et al.

(10) Patent No.: US 12,446,715 B1
(45) Date of Patent: Oct. 21, 2025

(54) TRAVEL PILLOW WITH A ZIPPERED BLANKET

(71) Applicants: Terry Wright, Clinton, MD (US); Jenise Wright, Clinton, MD (US)

(72) Inventors: Terry Wright, Clinton, MD (US); Jenise Wright, Clinton, MD (US)

( * ) Notice: Subject to any disclaimer, the term of this patent is extended or adjusted under 35 U.S.C. 154(b) by 138 days.

(21) Appl. No.: 18/509,486

(22) Filed: Nov. 15, 2023

(51) Int. Cl.
*A47G 9/10* (2006.01)
*A47G 9/02* (2006.01)

(52) U.S. Cl.
CPC ..... *A47G 9/1045* (2013.01); *A47G 9/0223* (2013.01)

(58) Field of Classification Search
CPC ..... A47C 7/383; A47G 9/0223; A47G 9/064; A47G 9/066
See application file for complete search history.

(56) References Cited

U.S. PATENT DOCUMENTS

| | | | | |
|---|---|---|---|---|
| 1,811,821 | A * | 6/1931 | Bloom | A47G 9/066 5/413 R |
| 3,258,781 | A * | 7/1966 | Klein | A41D 3/08 D2/866 |
| 4,217,662 | A * | 8/1980 | Buchman | A47G 9/066 2/69.5 |
| 7,513,001 | B1 | 4/2009 | Leach | |
| 9,439,463 | B1 * | 9/2016 | Spears | A41D 3/08 |
| 9,763,485 | B1 * | 9/2017 | Weitala | A41D 3/08 |
| 10,292,508 | B1 * | 5/2019 | Kim | A47G 9/1081 |
| 10,390,623 | B2 * | 8/2019 | Konigsberg | A47G 9/066 |
| 2009/0133192 | A1 * | 5/2009 | Hassell | A47C 7/383 5/639 |
| 2010/0139001 | A1 * | 6/2010 | Mangano | A47G 9/1045 297/229 |
| 2011/0258749 | A1 * | 10/2011 | Hibbs | A41D 15/04 2/84 |
| 2012/0144550 | A1 * | 6/2012 | Nejad | A41D 3/08 2/84 |
| 2014/0000036 | A1 * | 1/2014 | Cohen | A47C 27/081 5/639 |
| 2017/0164663 | A1 * | 6/2017 | Korenek | B60N 2/80 |
| 2017/0258154 | A1 * | 9/2017 | Peyser | A45F 3/00 |
| 2018/0000233 | A1 * | 1/2018 | Yilla | A45F 4/08 |
| 2018/0325292 | A1 * | 11/2018 | Kassab Arabo | A47C 7/383 |
| 2020/0253397 | A1 * | 8/2020 | Diaz | A47G 9/1081 |
| 2021/0353083 | A1 * | 11/2021 | Ali | F21V 33/0004 |
| 2023/0414015 | A1 * | 12/2023 | Voegel | A47G 9/066 |

FOREIGN PATENT DOCUMENTS

| | | | | |
|---|---|---|---|---|
| CN | 202636396 U | * | 1/2013 | |
| CN | 205963647 U | * | 2/2017 | |
| JP | 3218875 U | * | 11/2018 | |
| WO | WO-2015041384 A1 | * | 3/2015 | A47C 7/383 |

* cited by examiner

*Primary Examiner* — Eric J Kurilla
(74) *Attorney, Agent, or Firm* — Sanchelima & Associates, P.A.; Jesus Sanchelima; Christian Sanchelima

(57) ABSTRACT

A travel pillow with a zippered blanket including a pillow assembly and a blanket assembly. The pillow assembly includes a pillow. The blanket assembly includes a blanket having zipper portions on lateral sides thereof. The pillow has a major arc shape. The pillow has a curved top surface. The pillow is made of a memory foam fabric covered by velour fabric. The pillow is a travel pillow. The zipper is operated to close the blanket in a closed loop. The blanket can enclose a use. The blanket is attached to the pillow.

1 Claim, 3 Drawing Sheets

TRAVEL PILLOW WITH A ZIPPERED BLANKET

BACKGROUND OF THE INVENTION

1. Field of the Invention

The present invention relates to a travel pillow with a zippered blanket and, more particularly, to a travel pillow with a zippered blanket that allows having a pillow and a sheet to be used as a blanket.

2. Description of the Related Art

Several designs for pillows have been designed in the past. None of them, however, include a travel having a blanket attached thereto.

Applicant believes that a related reference corresponds to U.S. Pat. No. 10,390,623 issued for a neck pillow with pockets which are used to store deployable blankets. Applicant believes that another related reference corresponds to U.S. Pat. No. 7,513,001 issued for a multi-purpose pillow with attached blanket. None of these references, however, teach of a travel pillow with a zippered blanket that is comprised of a neck encircling the body of the wearer where the blanket is closed across the front of the user by the use of zipper fastener.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a travel pillow with a zippered blanket that includes a zipper to close the blanket around the user.

It is another object of this invention to provide a travel pillow with a zippered blanket that includes a blanket made of a fleece material.

It is still another object of the present invention to provide a travel pillow with a zippered blanket that includes a pillow with memory foam material.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
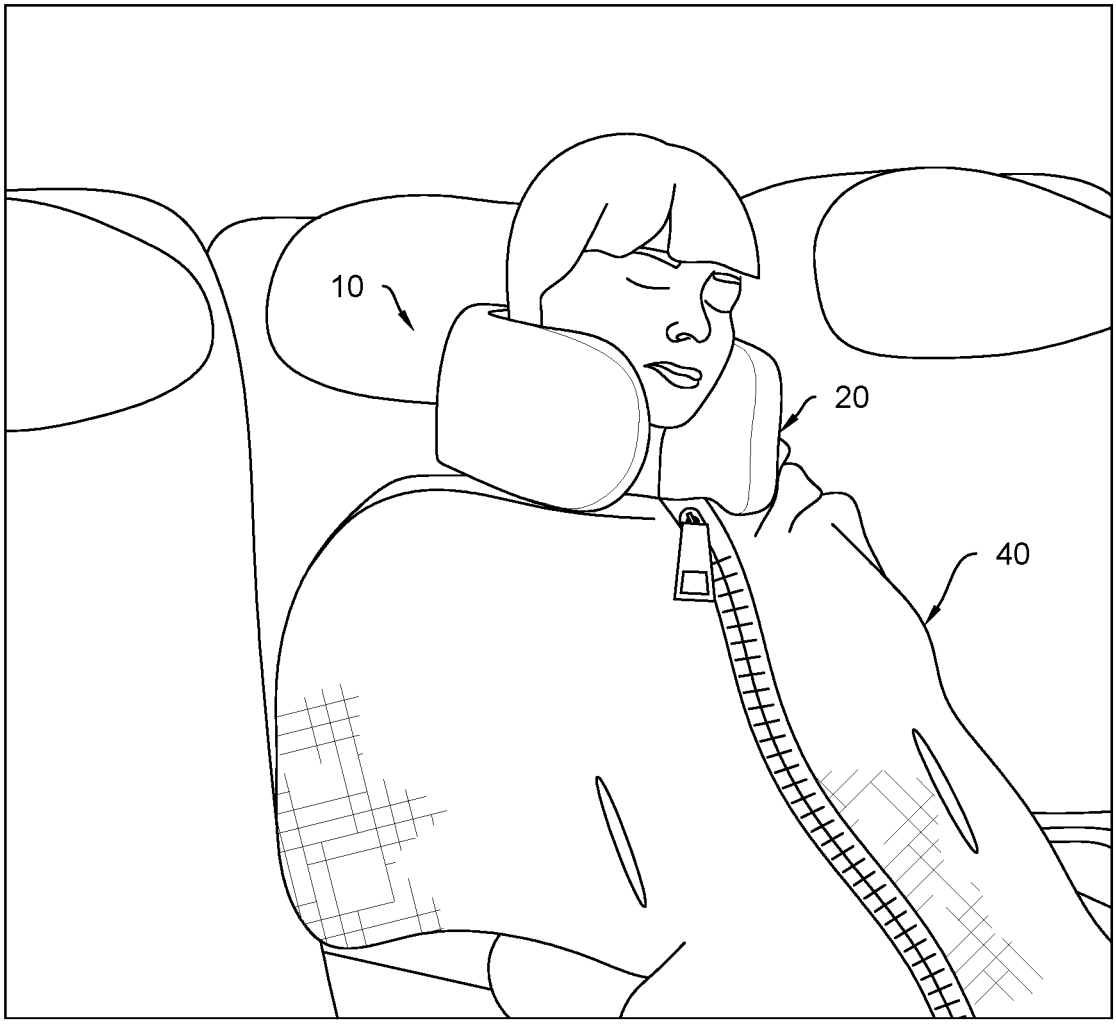
FIG. 1 represents an isometric operational view of the present invention 10.

Referring now to the drawings, where the present invention is generally referred to with numeral 10, it can be observed that it basically includes a pillow assembly 20 and a blanket assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The pillow assembly 20 includes a pillow 22. The pillow 22 may preferably be made of velour fabric on the outside and a memory foam therewithin. It also may be suitable for the pillow 22 to be made of cotton, polyester or any other suitable material. The pillow 22 may preferably have a major arch shape with a curved top surface. The pillow 22 may be adapted to surround a user's neck. The pillow 22 may be adapted to have the blanket assembly 40 thereto. The pillow 22 may preferably be a travel pillow. The pillow 22 may include arm slits 27. The arm slits 27 may be openings formed on central spaced portions of the pillow 22 that allows introducing the arms therethrough.

The blanket assembly 40 includes a zipper 42, a blanket 47 and a sliding member 44. The blanket 47 may be made of a fleece material. It also may be suitable for the blanket 47 to be made of velour fabric, cotton, or any other suitable shape. The blanket 47 may preferably have a rectangular shape. It also may be suitable for the blanket 47 to have a triangular shape, a circular shape, or any other suitable shape. The blanket 47 may have zipper portions of the zipper 42 stitched on lateral sides thereof. The zipper portions of the zipper 42 may be coupled therebetween to form a closed loop cover with an open bottom end. The blanket 47 may be flexible.

Figure 2:
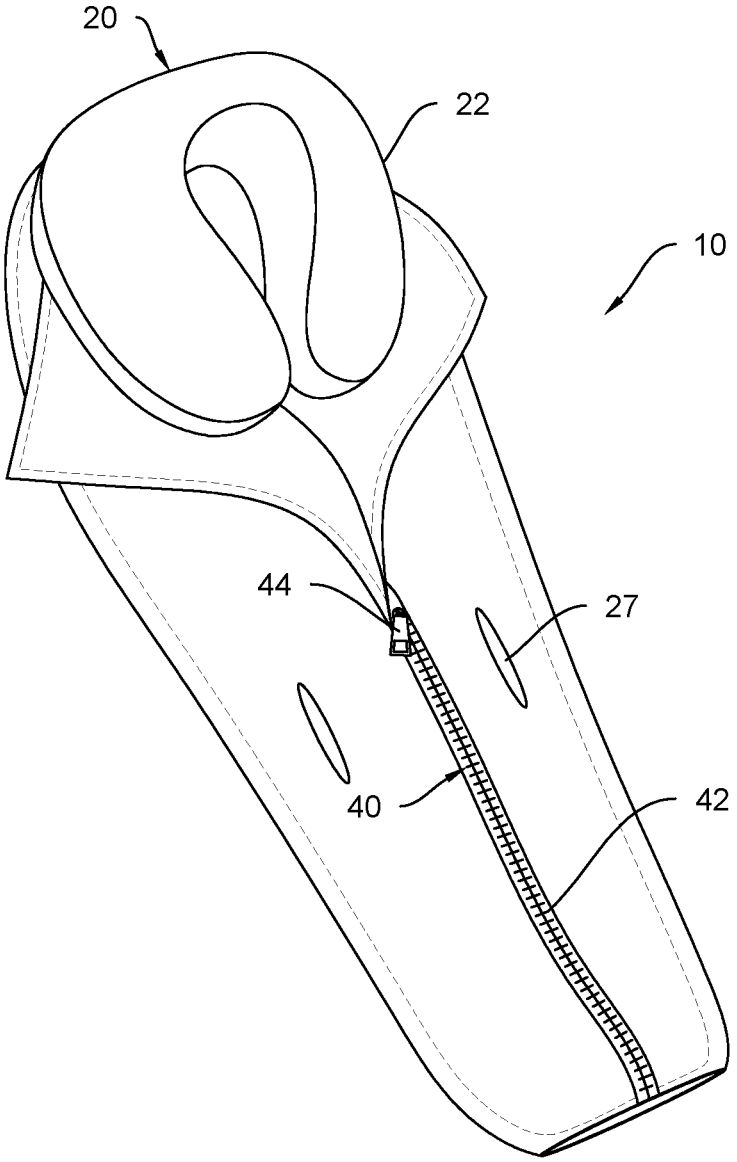
FIG. 2 shows an isometric view of the present invention 10 in a closed configuration. The present invention 10 includes a pillow assembly 20 and a blanket assembly 40.
Figure 3:
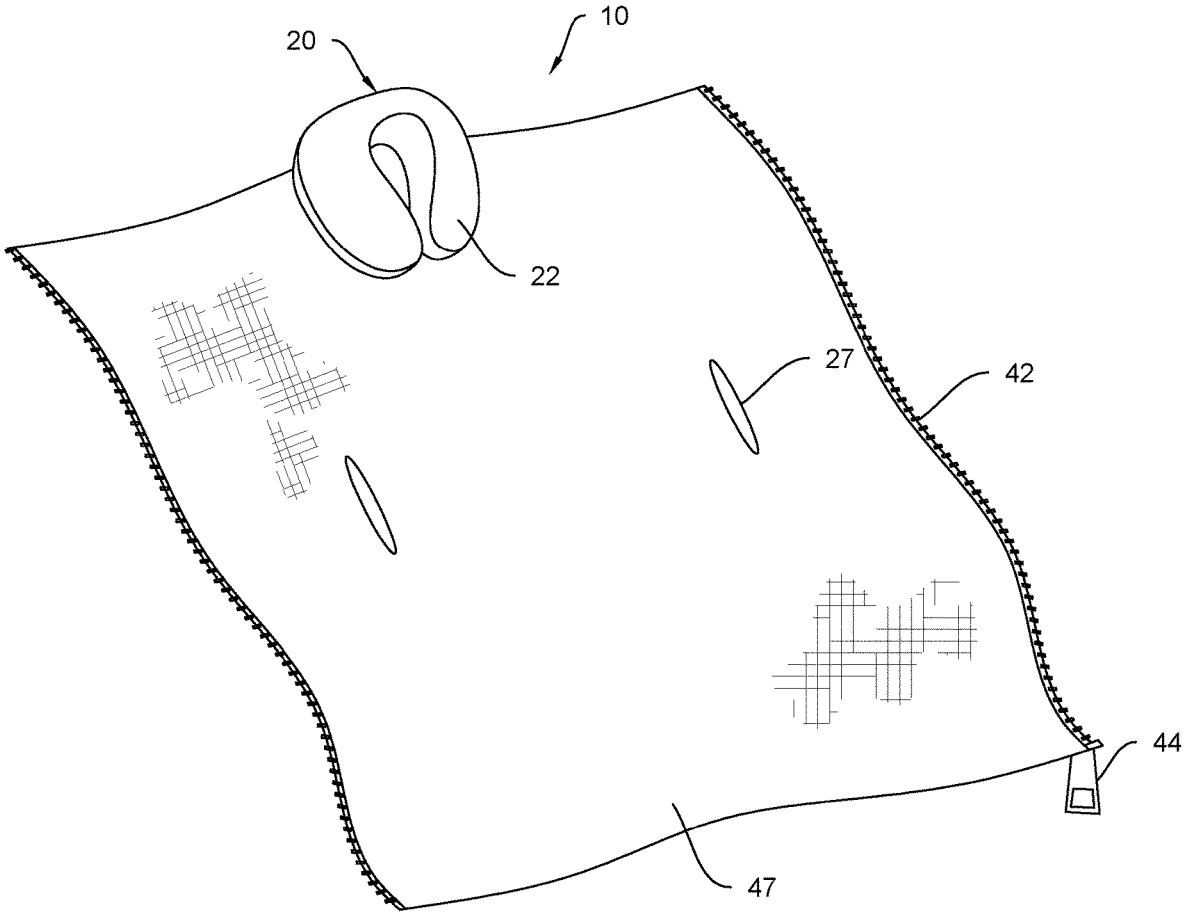
FIG. 3 illustrates an isometric operational view of the present invention 10 in an open configuration.

The zipper 42 may include the sliding member 44 slidable attached to one of the zipper portions of the zipper 42. The zipper 42 may be made of metal, plastic or any other suitable material. The sliding member 44 may have such a size that cooperates to slide the sliding member 44 and close the zipper 42. When the zipper 42 is closed, as best illustrated in FIG. 2, it may be used to entirely enclose user.

The blanket 47 may have a top central portion stitched to the pillow 22. In some embodiments the pillow 22 may include at least one compartment to receive the blanket 47 therein. The blanket 47 may be rolled up to save the blanket 47.

In a preferred embodiment illustrated in FIG. 1, user may unroll the blanket 47 from the pillow 22, place the pillow 22 around the neck and extend the blanket 47 around user to then closing the zipper 42 fully enclosing the user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A travel pillow with a zippered blanket, consisting of:

a pillow assembly, wherein said pillow assembly includes a pillow having a major arc shape, said pillow has a curved top surface, said pillow is made of a memory foam fabric covered by a velour fabric, said pillow is a travel pillow; and a blanket assembly, wherein said blanket assembly includes a blanket having a zipper portions on lateral sides thereof, said zipper is operated to close said blanket in a closed loop, wherein said blanket is configured to enclose a user, wherein a top central portion of said blanket is stitched to said pillow, wherein said blanket has a rectangular shape, said blanket is made of a fleece fabric material.

* * * * *